US006982242B2

(12) United States Patent
Liss et al.

(10) Patent No.: US 6,982,242 B2
(45) Date of Patent: Jan. 3, 2006

(54) AQUEOUS DETERGENT COMPOSITION AND METHOD OF USE

(75) Inventors: Audrey Brenda Liss, Newton, PA (US); Joseph Martin Rokowski, Riegelsville, PA (US); Thomas James Ennis, Glenmoore, PA (US)

(73) Assignee: Rohm and Haas Company, Philadelphia, PA (US)

( * ) Notice: Subject to any disclaimer, the term of this patent is extended or adjusted under 35 U.S.C. 154(b) by 88 days.

(21) Appl. No.: 10/808,863

(22) Filed: Mar. 24, 2004

(65) Prior Publication Data

US 2004/0214741 A1 Oct. 28, 2004

Related U.S. Application Data

(60) Provisional application No. 60/464,828, filed on Apr. 23, 2003.

(51) Int. Cl.

| | |
|---|---|
| ***C11D 1/66*** | (2006.01) |
| ***C11D 3/06*** | (2006.01) |
| ***C11D 3/36*** | (2006.01) |
| ***B05D 5/00*** | (2006.01) |
| ***B08B 3/04*** | (2006.01) |

(52) U.S. Cl. ..... 510/269; 510/175; 510/245; 510/271; 510/347; 510/360; 510/413; 510/421; 510/431; 510/467; 510/475; 510/534; 427/299; 427/322; 427/325; 427/327; 134/2; 134/22.12; 134/22.13; 134/22.14; 134/22.16; 134/22.17; 134/22.19; 134/39; 134/40; 134/41; 134/42

(58) Field of Classification Search ..... 510/175, 510/245, 269, 271, 347, 360, 413, 421, 431, 510/467, 475, 534; 427/299, 322, 325, 327; 134/2, 22.12, 22.13, 22.14, 22.16, 22.17, 134/22.19, 39, 40, 41, 42

See application file for complete search history.

(56) References Cited

U.S. PATENT DOCUMENTS

| | | | | |
|---|---|---|---|---|
| 5,062,979 | A | 11/1991 | Scharf et al. | |
| 5,215,582 | A | 6/1993 | Bolt et al. | |
| 5,334,325 | A | 8/1994 | Chaussee | |
| 5,380,454 | A | 1/1995 | Griepenburg et al. | |
| 5,509,969 | A | 4/1996 | Grawe | |
| 5,605,578 | A | 2/1997 | Hawes et al. | |
| 5,849,133 | A | 12/1998 | Senderling et al. | |
| 5,874,394 | A * | 2/1999 | Thomas et al. | 510/426 |
| 6,451,378 | B1 | 9/2002 | Ennis | |
| 6,480,371 | B1 | 11/2002 | Kinard et al. | |
| 2002/0164426 | A1 | 11/2002 | Ennis et al. | |
| 2004/0214741 | A1 * | 10/2004 | Liss et al. | 510/421 |

FOREIGN PATENT DOCUMENTS

| | | |
|---|---|---|
| WO | WO 99/46358 | 9/1999 |

OTHER PUBLICATIONS

Kirk-Othmer, "Sugar To Thin Films", Encyclopedia Of Chemical Technology, Fourth Edition, vol. 23, John Wiley & Sons, pp. 506-507.

* cited by examiner

*Primary Examiner*—Brian P. Mruk
(74) *Attorney, Agent, or Firm*—Kim R. Jessum; Andrew E. C. Merriam

(57) ABSTRACT

An aqueous detergent composition is provided containing phosphoric acid or salt thereof, an organic phosphate surfactant, a nonionic surfactant, and water. The aqueous detergent composition may be employed to improved the adhesion of a coating to a substrate. Also provided is a method of improving the adhesion of a coating to a substrate.

14 Claims, No Drawings

QUEOUS DETERGENT COMPOSITION AND METHOD OF USE

CROSS REFERENCE TO RELATED PATENT APPLICATIONS

This is a non-provisional application of prior pending U.S. provisional application Ser. No. 60/464,828 filed Apr. 23, 2003.

The present invention relates generally to an aqueous detergent composition. In particular, the present invention relates to an aqueous detergent composition that is useful for improving the adhesion of a coating to a substrate. Also provided is a method for improving the adhesion between a coating and a substrate.

EPDM (ethylene-propylene diene monomer) rubber and asphalt membranes encompass about 70% of the total roofing market. A large portion of the remaining market includes various metal substrates, such as aluminum and galvanized steel. Other substrates used are single ply substrates made from PVC (polyvinyl chloride), TPO (thermoplastic polyolefin), and Hypalon™ rubber. Hypalon is a tradename for a synthetic rubber produced by DuPont Dow. It is described as a chlorosulfonated polyethylene and is produced as white chips. It can be used for the production of many products, including sheet roofing substrates and protective or decorative coatings. Still other substrates used include spray applied polyurethane foam. All of these substrates can benefit from the use of a coating to improve aesthetics, reduce energy costs, and improve durability.

The architectural coatings industry uses paints to coat similar substrates used in the roofing market. The paint market has somewhat different performance criteria than coatings used in roofing; i.e. paints are applied thinner (75 to 200 microns dry versus 500 to 650 microns dry for roof mastics) and paints are not expected to perform in areas where water ponding is prevalent. Many of the metal substrates used in the roofing market are used for applications in the architectural markets. Metal substrates used in both the architectural and roofing markets can be factory applied as well as painted at the job site. The architectural coatings industry utilizes many other substrates not prevalent in the roofing market. Pressure treated wood, chalky acrylic and factory applied coatings to aluminum and vinyl substrates are examples of commonly used materials that can be painted. Coating these substrates is necessary because of degradation and weathering. Weathered substrates that have been previously painted frequently have chalky surfaces that are difficult to adhere to, yet need to be recoated to prevent degradation of the substrate.

In either the roofing or architectural industry, one important criteria for the coating is the ability of this coating to adhere well to the substrate. Cleaning with water before coating may improve adhesion of the coating as compared to not rinsing the substrate surface. Cleaning with detergents is also known to improve adhesion.

U.S. Patent Application Publication No. 2002/0164426 A1 discloses a method of improving the adhesion of a coating to the surface of a substrate by treating the substrate with a detergent composition containing phosphates, silicates, and optionally, an alkylphenol ethoxylated surfactant, also referred to as an "APE surfactant". The disclosed detergent composition has a pH of at least 8, and most preferably, a pH in the range of from 12 to 14. The detergent composition of example 1 in this reference has a pH of above 13. The use of these high pH detergent compositions typically require special handling by workers. Also, extra attention is often required to ensure that the caustic high pH detergent composition that is rinsed from a surface, such as a roof, does not contact surrounding vegetation. Further, the disclosed compositions, as exemplified by example 1 in the reference, may contain APE surfactant. The effect of APE surfactants on aqueous life is presently being studied. Bans on the use of APE surfactants have been implemented in some communities and are being considered in many other communities.

Although detergent compositions are known for improving the adhesion of a coating to a substrate, desired are detergent compositions having neutral or near neutral pHs that provide improved adhesion of a coating to a substrate. Detergent compositions that have neutral or near neutral pHs do not require the special handling need for caustic materials. It is also desired that the detergent composition is substantially free or completely free of APE surfactant to allow compliance to existing or future regulatory bans to the use of APE surfactants.

The inventors have surprisingly found an aqueous detergent composition that provides improved adhesion of a coating to a substrate. This aqueous detergent composition may be formulated at neutral or near neutral pH and may be provided as an APE surfactant free composition. Further, the aqueous detergent composition may be provided at lower phosphate levels than the disclosed detergent composition of U.S. Patent Application Publication No. 2002/0164426 A1.

According to the first aspect of the present invention, an aqueous detergent composition is provided containing, based on weight of the aqueous detergent composition: from 0.5 to 5 weight % phosphoric acid or salt thereof; from 0.25 to 5 weight % organic phosphate surfactant; from 0.25 to 5 weight % nonionic surfactant having a hydrophile-lipophile balance number in the range of from 6 to 18; and water; wherein the aqueous detergent composition has a pH in the range of from 3 to 11.

A second aspect of the present invention relates to a method for improving adhesion between a coating and a substrate, including the steps of: applying an aqueous detergent composition onto a surface of the substrate, wherein the aqueous detergent composition contains, based on the weight of the aqueous detergent composition: from 0.5 to 5 weight % phosphoric acid or salt thereof; from 0.25 to 5 weight % organic phosphate surfactant; from 0.25 to 5 weight % nonionic surfactant having a hydrophile-lipophile balance number in the range of from 6 to 18; and water; wherein the aqueous detergent composition has a pH in the range of from 3 to 11; rinsing the surface of the substrate with water to remove the aqueous detergent composition; applying a coating composition to the surface of the substrate; and drying or allowing to dry the coating composition applied onto the surface of said substrate.

The aqueous detergent composition of the present invention contains phosphoric acid or salt thereof. The salt of phosphoric acid may be a mono-, di-, or trisalts of phosphoric acid. Examples of phosphoric acid salts include ammonium, lithium, sodium, and potassium salts of phosphoric acid such as trisodium phosphate, dipotassium hydrogen phosphate, lithium dihydrogen phosphate, and ammonium dihydrogen phosphate, as well as mixed salts of phosphoric acid. Typically, the aqueous detergent composition contains from 0.5 to 5 weight %, and preferably from 1 to 4 weight % phosphoric acid or salt thereof, based on the weight of the aqueous detergent composition. Mixtures of phosphoric acid and one or more phosphoric acid salts may be used.

The aqueous detergent composition also contains from 0.25 to 5 weight % and preferably from 0.5 to 3 weight % of at least one organic phosphate surfactant, based on the weight of the aqueous detergent composition. The organic phosphate surfactant includes monoesters and diesters of phosphoric acid. The ester groups are formed, for example, from fatty alcohols, synthetic alcohols, polyalkylene oxides such as polyethylene oxide and polypropylene oxide, and capped polyalkylene oxides. The organic phosphate surfactant may be provided in the acid form or in the salt form. Examples of suitable organic phosphate surfactants include butyl phosphate, hexyl phosphate, 2-ethylhexyl phosphate, octyl phosphate, decyl phosphate, octyldecyl phosphate, mixed alkyl phosphates, hexyl polyphosphate, octyl polyphosphate, phosphated glycerol monoester of mixed fatty acids, phosphated 2-ethylhexyl ethoxylate, phosphated tridecyl alcohol ethoxylate, phosphated octylphenol ethoxylate, and phosphate nonyl phenol ethoxylate. Mixtures of one or more different organic phosphate surfactants may be used in the aqueous detergent composition.

The aqueous detergent composition further contains from 0.25 to 5 weight % and preferably from 0.5 to 3 weight % of at least one nonionic surfactant, based on the weight of the aqueous detergent composition. Examples of suitable nonionic surfactants include nonionic ether surfactants such as ethoxylated alcohols and propoxylated alcohols. Ethoxylated alcohols are represented by the formula $R—(OCH_2CH_2)_n—OH$, wherein R is a hydrophobe group, $—(OCH_2CH_2)_n—$ represents a polyethylene oxide chain, and n represents the average number of polymerized ethylene oxide units in the polyethylene oxide chain. The hydrophobe group may be a linear, branched, or cyclic alkyl group; an linear branched, or cyclic alkyl group; or an aromatic group. Examples of suitable hydrophobe groups include $C_6$ to $C_{24}$ alkyl groups such as lauryl, cetyl, stearyl, isostearyl, tridecyl, oleyl, and trimethylnonyl groups. Other suitable hydrophobe groups are formed from alkyl phenols such as octylphenol, nonylphenol, and dodecyl phenol groups. Typically, the average length of the polyethylene oxide chain, n, is in the range of from 2 to 100. Preferred nonionic surfactants are ethoxylated alcohols containing $C_6$ to $C_{24}$ alkyl groups. Examples of nonionic surfactants suitable in the aqueous detergent composition of this invention have hydrophile-lipophile balance (HLB) numbers in the range of from 6–18. Other examples of suitable nonionic surfactants have HLB numbers in the range of from 8 to 16. Further examples of suitable nonionic surfactants have HLB numbers in the range of from 10 to 15. HLB numbers for nonionic surfactants are discussed in *Kirk-Othmer Encyclopedia of Chemical Technology* ($4^{th}$ Ed.), Vol. 23, pages 506–507 (1997).

The aqueous detergent composition also contains water. Other components may be included in the aqueous detergent composition such as biocides, flow aides, defoamers, wetting agents, and water miscible solvents such as 2-butoxyethanol and 2-(2-butoxyethyoxy)ethanol.

The pH of the aqueous detergent composition is in the range of from 3 to 11, preferably in the range of from 4 to 9, more preferably in the range of from 5 to 8, and most preferably in the range of from 6 to 7. Various substances may be added to the aqueous detergent composition to adjust the pH, including bases, acids, or buffers. Suitable bases include hard bases such as sodium hydroxide, potassium hydroxide, and lithium hydroxide; ammonia; organic amines such as monomethylamine, monoethylamine, methylethylamine, monoethanolamine, and 1-amino-2-propanol; and combinations thereof.

Preferably the aqueous detergent composition of this invention is substantially free of alkylphenol ethoxylated surfactants, referred to herein as "APE surfactants". As used herein, "substantially free of APE surfactants" means less than 0.25 weight %, preferably less than 0.1 weight %, and more preferably less than 0.05 weight % APE surfactant, based on the weight of the aqueous detergent composition. The aqueous detergent composition having zero APE surfactant is most preferred.

The aqueous detergent composition is prepared by admixing the various ingredients in any addition order. Typically, phosphoric acid is added to the water with mixing. The surfactants may be added at any time in the preparation. Generally, the base is added last and in an appropriate amount to obtain the desired pH. Alternatively, a salt of phosphoric acid may partially or completely replace the phosphoric acid, followed by the optional addition of acid or base, as required to obtain the desired pH.

In one aspect of this invention, a method is provided to improve the adhesion of a coating with a substrate. The method includes applying the aqueous detergent composition of this invention onto a surface of said substrate; rinsing the surface of the substrate with water to remove the aqueous detergent composition; applying a coating composition to the surface of the substrate; and drying or allowing to dry the coating composition applied onto the surface of the substrate.

The aqueous detergent composition may be applied by various methods known in the art, such as spraying, brushing, dipping, roller, and pouring. Allowing the aqueous detergent composition to contact all the surface of the substrate helps minimize areas of weak adhesion between the applied coating and the substrate. The aqueous detergent composition is preferably left to stand in contact with the surface of the substrate for at least 5 minutes. For example, though an improvement in adhesion of a coating may be measured when the aqueous detergent composition is left to treat the surface for less than 30 seconds, the best results are achieved when the aqueous detergent composition is allowed to contact the surface for at least 5 minutes. A contact time significantly over 5 minutes will tend not to lead to any significant further improvements in adhesion, though in practice, contact times may be from 10 to 60 minutes depending on the size of the substrate, the application method, and the speed of the operator. Permitting the aqueous detergent composition to dry on the surface before rinsing may not be detrimental to the method of the present invention, provided the surface is rinsed well afterwards to remove the dried detergent composition. Preferably, the rinsing removes substantially all of the aqueous detergent composition from the surface of the substrate. High efficiency rinsing may involve the use of a stiff brush or the use of a high pressure hose. Typically, the high pressure hose will release the rinse water at a pressure of $7\times10^6$ $N/m^2$ (1000 psi) or greater.

The aqueous detergent composition is useful for treating various substrates to improve adhesion between a coating and the substrate. Examples of suitable substrates include EPDM rubber, aluminum, galvanized steel, vinyl, polyvinyl chloride, thermoplastic polyolefin, chlorosulfonated polyethylene, pressure treated wood, plywood, asphalt, cementitious surfaces, previously painted surfaces, and chalky acrylic coated surfaces.

The following examples are presented to illustrate the composition and the process of the invention. These examples are intended to aid those skilled in the art in understanding the present invention. The present invention is, however, in no way limited thereby.

EXAMPLE 1

The aqueous detergent composition was prepared by admixing the ingredients in the order listed in Table 1.1. After the addition of the ingredients in Table 1.1, the aqueous detergent mixture was mixed for 10 additional minutes.

TABLE 1.1

Ingredients for Preparing the Aqueous Detergent Composition of Example 1

| Ingredient | Quantity (grams) |
|---|---|
| water | 3482 |
| phosphoric acid (85 weight %) | 74 |
| polyoxyethylene tridecyl ether phosphate with average EO chain length of 9 | 33.3 |
| $C_{11}$–$C_{15}$ alkyloxypolyethyleneoxyethanol with average EO chain length of 9 (HLB number 13.3) | 48.1 |
| monoethanolamine | 63 |

The pH of the aqueous detergent composition of Example 1 is 6.5.

Comparative Aqueous Detergent Composition

A comparative aqueous detergent composition, Comparative A, was prepared by admixing the ingredients listed in Table A. Comparative A had a pH greater than 13.

TABLE A

Ingredients for the Preparation of Comparative Aqueous Detergent Composition, Comparative A

| Ingredient | Quantity (grams) |
|---|---|
| water | 87.8 |
| sodium metasilicate | 5.0 |
| trisodium phosphate | 5.0 |
| soap mixture | 2.2 |

Soap mixture=124 parts octylphenoxypolyethoxyethanol, 58.5 parts octylphenoxypolyethoxyethylphosphate, 3.9 parts polyethylene glycol, 11.7 parts phosphoric acid, and 18.9 parts water, on a weight basis. Octylphenoxypholyethoxyethanol is an APE surfactant.

EXAMPLE 2

Preparation of Coated Substrate Samples

A sheet of EPDM rubber roofing membrane, approximately 30 cm by 60 cm, was attached to a fixed horizontal surface. The aqueous detergent composition of Example 1 was applied to one section of the top surface of the EPDM rubber sheet by spraying at an application rate of 12.3 meter$^2$/liter. Next, the applied aqueous detergent composition of Example 1 was brushed over that section of the surface and allowed to remain on the surface for 5 minutes. Then, the applied aqueous detergent composition of Example 1 was rinsed from the surface of the EPDM rubber sheet with water using a high pressure hose ($2.4\times10^7$ N/m$^2$).

A second section of the surface of the EPDM rubber sample was left untreated by the aqueous detergent composition of Example 1, but was rinsed with water using a high pressure hose. The roof mastic coating in Table 2.1 was applied by brushing to the treated and the untreated sections of the EPDM rubber sample. Two coats of the roof mastic coating were applied. The dry thickness of the applied roof mastic coating was 380 to 500 microns.

TABLE 2.1

Roof Mastic Coating

| | Ingredients | Quantity (kg/378.4 liters)* |
|---|---|---|
| Grind: | water | 69.2 |
| | Tamol ™ 850 dispersant (Rohm and Haas Company) | 2.2 |
| | potassium tripolyphosphate | 0.6 |
| | Nopco ™ NXZ defoamer (Cognis Corp.) | 0.9 |
| | Duramite ™ calcium carbonate (ECC America, Inc.) | 191.5 |
| | TiPure ™ R-960 titanium dioxide | 31.9 |
| | Kadox ™ 915 zinc oxide | 21.3 |
| Letdown: | Rhoplex ™ EC-1791 emulsion (55 wt. %) | 213.5 |
| | Nopco ™ NXZ defoamer | 0.9 |
| | Texanol ™ coalescent (Eastman Chemical Co.) | 3.2 |
| | Skane ™ M-8 biocide (Rohm and Haas Company) | 1.0 |
| | ammonia (28 wt. %) | 0.5 |
| | propylene glycol | 11.1 |
| | Natrosol ™ 250 MXR thickener (Aqualon Corp.) | 1.9 |

*kg/378.54 liters is equal to lbs/gal.

Comparative samples were also prepared by the general procedure described above, except that the EPDM rubber samples were treated with either Comparative A or with water, instead of treatment with Example 1.

EXAMPLE 3

Evaluation of Coated Sample and Comparative Samples

The samples applied to the new EPDM rubber were conditioned prior to testing as follows:

Dry Peel Adhesion Test: 14 days at 23° C. at 50% relative humidity.

Wet Peel Adhesion Test: The sample was allowed to dry and to condition for 14 days at 23° C. at 50% relative humidity, and then soaked in water for 7 days prior to testing.

The samples applied to the weathered EPDM rubber were conditioned prior to testing as follows:

Dry Peel Adhesion Test: 3 days at 23° C. and 50% relative humidity, 2 days in a 50° C. oven, and then 2 days at 23° C. at 50% relative humidity.

Wet Peel Adhesion Test: The sample was allowed to dry and to condition for 3 days at 23° C. and 50% relative humidity, 2 days in a 50° C. oven, 2 days at 23° C. at 50% relative humidity, and then soaked in water for 7 days prior to testing.

The coated samples were subjected to dry and wet peel adhesion tests. These were performed in accordance with ASTM Protocol C794, except for changes to the drying and conditioning of samples as noted hereinabove. Acceptable dry peel adhesion to new EPDM rubber was indicated by a value of at least 100 N/m. Acceptable dry peel adhesion to weathered EPDM rubber was indicated by a value of at least 500 N/m. Acceptable wet peel adhesion to new EPDM rubber was indicated by a value of at least 200 N/m. Acceptable wet peel adhesion to weathered EPDM rubber was indicated by a value of at least 200 N/m.

TABLE 3.1

Dry and Wet Peel Adhesion of Coated Samples

| | Example 1 | Comparative A | Water |
|---|---|---|---|
| New EPDM Rubber | | | |
| Dry Peel Adhesion | 140 N/m | 175 N/m | 70 N/m |
| Wet Peel Adhesion | 210 N/m | 228 N/m | 70 N/m |
| Weathered EPDM Rubber | | | |
| Dry Peel Adhesion | 560 N/m | 587 N/m | 257 N/m |
| Wet Peel Adhesion | 250 N/m | 228 N/m | 81 N/m |

The results in Table 3.1 show that the coated samples that were treated with either the aqueous detergent composition of Example 1 or with the comparative aqueous detergent composition of Comparative A provided coated samples with acceptable levels of dry and wet peel adhesion to new EPDM rubber as well as to weathered EPDM rubber. Example 1 had a pH of approximately 6.5 and did not contain APE surfactant. In contrast, Comparative A had a pH of greater than 13 and contained APE surfactant. Treatment of the EPDM rubber with only water did not provide acceptable levels of dry or wet peel adhesion to either new EPDM rubber or to weathered EPDM rubber.

What is claimed is:

1. An aqueous detergent composition comprising, based on weight of said aqueous detergent composition:

a) from 0.5 to 5 weight % phosphoric acid or salt thereof;

b) from 0.25 to 5 weight % organic phosphate surfactant;

c) from 0.25 to 5 weight % nonionic surfactant having a hydrophile-lipophile balance number in the range of from 6 to 18; and d) water;

wherein said aqueous detergent composition has a pH in the range of from 3 to 11.

2. The aqueous detergent composition according to claim 1 wherein said pH is in the range of from 5 to 8.

3. The aqueous detergent composition according to claim 2 wherein said pH is in the range of from 6 to 7.

4. The aqueous detergent composition according to claim 1 wherein said nonionic surfactant has a hydrophile-lipophile balance number in the range of from 8 to 16.

5. The aqueous detergent composition according to claim 4 wherein said nonionic surfactant has a hydrophile-lipophile balance number in the range of from 10 to 15.

6. The aqueous detergent composition according to claim 1 comprising less than 0.25 weight % alkylphenol ethoxylated surfactant, based on weight of said aqueous detergent composition.

7. A method for improving adhesion between a coating and a substrate, comprising the steps of:

a) applying an aqueous detergent composition onto a surface of said substrate, wherein said aqueous detergent composition comprises, based on the weight of said aqueous detergent composition:

i) from 0.5 to 5 weight % phosphoric acid or salt thereof;

ii) from 0.25 to 5 weight % organic phosphate surfactant;

iii) from 0.25 to 5 weight % nonionic surfactant having a hydrophile-lipophile balance number in the range of from 6 to 18; and iv) water;

wherein said aqueous detergent composition has a pH in the range of from 3 to 11;

b) rinsing said surface of said substrate with water to remove said aqueous detergent composition;

c) applying a coating composition to said surface of said substrate; and d) drying or allowing to dry said coating composition applied onto said surface of said substrate.

8. The method according to claim 7 wherein said substrate is selected from the group consisting of aluminum, galvanized steel, vinyl, polyvinyl chloride, thermoplastic polyolefin, chlorosulfonated polyethylene, pressure treated wood, plywood, EPDM rubber, cementitious surfaces, asphalt, and chalky acrylic coated surfaces.

9. The method according to claim 7 wherein the rinsing comprises a power wash at a pressure of at least $7\times10^6$ N/m$^2$.

10. The method according to claim 7 wherein said pH is in the range of from 5 to 8.

11. The method according to claim 10 wherein said pH is in the range of from 6 to 7.

12. The method according to claim 7 wherein said nonionic surfactant has a hydrophile-lipophile balance number in the range of from 8 to 16.

13. The method according to claim 12 wherein said nonionic surfactant has a hydrophile-lipophile balance number in the range of from 10 to 15.

14. The method according to claim 7 wherein said aqueous detergent composition comprises less than 0.25 weight % alkylphenol ethoxylated surfactant, based on weight of said aqueous detergent composition.

* * * * *